US012692652B2

(12) United States Patent
Lacamera et al.

(10) Patent No.: US 12,692,652 B2
(45) Date of Patent: Jul. 28, 2026

(54) RENOVATION CEILING MAT

(71) Applicant: Owens Corning Intellectual Capital, LLC, Toledo, OH (US)

(72) Inventors: Domenico Lacamera, Breda (NL); Sander C. Hagens, Amersfoort (NL)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 914 days.

(21) Appl. No.: 16/325,990

(22) PCT Filed: Aug. 3, 2018

(86) PCT No.: PCT/US2018/045129
§ 371 (c)(1),
(2) Date: Feb. 15, 2019

(87) PCT Pub. No.: WO2019/032393
PCT Pub. Date: Feb. 14, 2019

(65) Prior Publication Data

US 2021/0363693 A1 Nov. 25, 2021

(30) Foreign Application Priority Data

Aug. 7, 2017 (EP) ..... 17185154

(51) Int. Cl.
*D06N 3/00* (2006.01)
*D04H 1/413* (2012.01)
(Continued)

(52) U.S. Cl.
CPC ..... *D06N 3/0063* (2013.01); *D04H 1/413* (2013.01); *D04H 1/4218* (2013.01); *D04H 1/587* (2013.01);
(Continued)

(58) Field of Classification Search
CPC ..... E04F 13/002; D04H 1/413; D04H 1/4218; D04H 1/587; D06N 3/0063; D06N 3/0011;
(Continued)

(56) References Cited

U.S. PATENT DOCUMENTS 7,033,963 B2 4/2006 Felegi, Jr. et al.
7,294,363 B2 11/2007 Grove, III et al.
(Continued)

FOREIGN PATENT DOCUMENTS

EP 1582622 A2 * 10/2005 ..... B32B 27/12
EP 2053083 A1 4/2009
(Continued)

OTHER PUBLICATIONS

"EP1582622_Machine Translation" is a machine translation of EP-1582622-A2. (Year: 2005).*
(Continued)

*Primary Examiner* — Larissa Rowe Emrich
(74) *Attorney, Agent, or Firm* — Calfee, Halter & Griswold LLP

(57) ABSTRACT

A mat for covering at least part of a ceiling made up of individual tiles. The mat renovates (e.g., improves, alters) the appearance of the ceiling. The mat is constructed so as to not impede the acoustical performance of the tiles being covered.

10 Claims, 4 Drawing Sheets

(51) Int. Cl.
*D04H 1/4218* (2012.01)
*D04H 1/587* (2012.01)
*D06N 3/04* (2006.01)
*E04F 13/00* (2006.01)

(52) U.S. Cl.
CPC ..... *D06N 3/0011* (2013.01); *D06N 3/0022* (2013.01); *D06N 3/0086* (2013.01); *D06N 3/04* (2013.01); *E04F 13/002* (2013.01); *D06N 2201/082* (2013.01); *D06N 2205/14* (2013.01); *D06N 2209/025* (2013.01); *D06N 2211/06* (2013.01); *D10B 2503/04* (2013.01)

(58) Field of Classification Search
CPC .... D06N 3/0022; D06N 3/04; D06N 2211/06; D06N 7/00–006; D10B 2503/04
See application file for complete search history.

(56) References Cited

U.S. PATENT DOCUMENTS 7,429,544 B2 * 9/2008 Grove ..... D06N 3/0063 442/2
7,757,810 B2 7/2010 Sparks et al.
7,833,638 B2 11/2010 Zheng et al.
7,837,009 B2 11/2010 Gross et al.
7,842,629 B2 11/2010 Jaffee
8,039,058 B2 10/2011 Grove et al.
8,684,134 B2 4/2014 Dugan et al.
8,925,677 B2 1/2015 Dugan et al.
9,243,401 B2 1/2016 Kragness et al.
9,346,244 B2 5/2016 Hauber et al.
9,375,753 B2 6/2016 Laukhuff et al.
9,938,659 B2 4/2018 Foss et al.
10,005,102 B2 6/2018 Ketzer et al.
10,060,058 B2 8/2018 Teng et al.
2002/0134616 A1 9/2002 Sheperd
2003/0068942 A1 * 4/2003 Kranendonk ..... B32B 27/12 442/59
2003/0199629 A1 * 10/2003 Gelman ..... D21H 19/20 524/514
2004/0002274 A1 1/2004 Tilton
2005/0166506 A1 8/2005 Morelissen et al.
2005/0223947 A1 * 10/2005 Huang ..... C09D 5/02 427/355
2006/0292948 A1 * 12/2006 Geel ..... D21H 13/40 442/59
2007/0028545 A1 2/2007 Schreuder et al.
2007/0079562 A1 4/2007 Buck et al.
2008/0014815 A1 * 1/2008 Geel ..... D21H 13/40 442/59
2008/0045101 A1 2/2008 Near et al.
2009/0100778 A1 4/2009 Ruid et al.
2009/0104425 A1 * 4/2009 Nandi ..... D06N 3/0063 428/221
2009/0252941 A1 10/2009 Mueller et al.
2010/0140029 A1 6/2010 Parild et al.
2010/0261398 A1 10/2010 Dry et al.
2011/0076470 A1 3/2011 Zaveri
2012/0285643 A1 11/2012 Yu
2013/0230710 A1 9/2013 Ombe Wandji
2013/0330513 A1 * 12/2013 Ketzer ..... E04F 13/002 428/143
2015/0000558 A1 1/2015 Ha et al.
2015/0140269 A1 5/2015 Bahnmiller
2015/0158765 A1 * 6/2015 Ketzer ..... D06N 3/0022 428/206
2015/0240492 A1 8/2015 Teng et al.
2016/0138264 A1 5/2016 Kragness et al.
2016/0208434 A1 * 7/2016 Hamdani-Devarennes ..... C03C 25/1095
2017/0284093 A1 10/2017 Lai et al.
2017/0321429 A1 11/2017 Kantor
2018/0148930 A1 5/2018 Grimsson

FOREIGN PATENT DOCUMENTS

WO 2001079600 A2 10/2001
WO 2005063502 A2 7/2005
WO 2005066429 A1 7/2005
WO 2015175733 A1 11/2015

OTHER PUBLICATIONS

International Search Report and Written Opinion from PCT/US2018/045129 dated Oct. 17, 2018.
Office Action from CN Application No. 201880063896.4 dated Dec. 15, 2021.
Office Action from RU Application No. 2020109225 dated Nov. 19, 2021.

* cited by examiner

RENOVATION CEILING MAT

This application is the U.S. national stage entry of PCT/US2018/045129, filed on Aug. 3, 2018, which claims priority to and all benefit of EP Patent Application No. 17185154.6, filed on Aug. 7, 2017, the entire disclosures of which are fully incorporated herein by reference.

FIELD

The present invention relates generally to non-woven mats, particularly fibreglass mats, and their use in the renovation of acoustic ceiling tile frameworks.

BACKGROUND

A conventional acoustic panel, such as a ceiling tile, can comprise a non-woven composite structure, including a core or board composed of base fibres, fillers, and binders. In the case of mineral wool boards, the core is generally combined with a veil to provide aesthetic properties and form the panel structure. Veils are generally made up of a mat of fibres, such as glass fibres, mixed with binders, fillers, surfactants, and other additives. Depending on the desired characteristics of the veil, the fillers may be a variety of materials including alumina, clay, calcium carbonate, and the like. The binders are typically resins, starch, polyvinyl alcohol, latex, and the like. Upon curing, the binder forms bonds with the base fibres and fillers to form a fibrous network providing acoustic properties.

Drop or suspended ceiling panels are one form of acoustic panel and are used in a variety of structures to provide versatile ceiling coverage. Over time, individual panels can become stained (e.g., from water leaks above the panel), damaged, or otherwise in need of replacement to improve the aesthetics of the ceiling. When this happens, owners generally replace the existing, stained panel with an identical replacement panel. However, replacing fewer than all of the panels can lead to aesthetic issues as well, since newer panels are likely to have a different appearance than older panels. Furthermore, replacing all of the panels can be costly when only a few of the panels are compromised. Thus, there is an unmet need for a system for renovating an acoustic ceiling tile framework that avoids these drawbacks.

SUMMARY OF THE INVENTION

The present inventors have developed a novel system for renovating an acoustic ceiling tile framework, which successfully balances the need for effective stain covering with the maintenance of the acoustic properties of the existing ceiling tiles.

Accordingly, in one aspect the invention provides a renovation mat for an acoustic ceiling tile framework. The mat comprises a non-woven web of fibres, a first binder, a filler, and a second binder. The filler preferably comprises at least one of aluminium trihydrate, calcium carbonate, magnesium oxide, magnesium hydroxide, titanium dioxide, talc, barium sulphate, kaolin, or mixtures thereof, and is present in an amount of 100 $g/m^2$ to 500 $g/m^2$.

A renovation mat of the present invention meets the following criteria (as further defined below):

(i) an air porosity of at least 100 $l/m^2/sec$ at 100 Pa;

(ii) a $\Delta E \leq 2$.

The present inventors have identified that mats meeting these criteria are suitable for use in the renovation of damaged/stained ceiling tiles, in particular for use underlying an existing ceiling tile framework. Methods of use of the inventive mats are also provided and described herein. The renovation systems and methods of the invention provide effective stain coverage while maintaining the desired acoustic properties of the ceiling.

GENERAL DESCRIPTION AND DEFINITIONS

Figure 1:
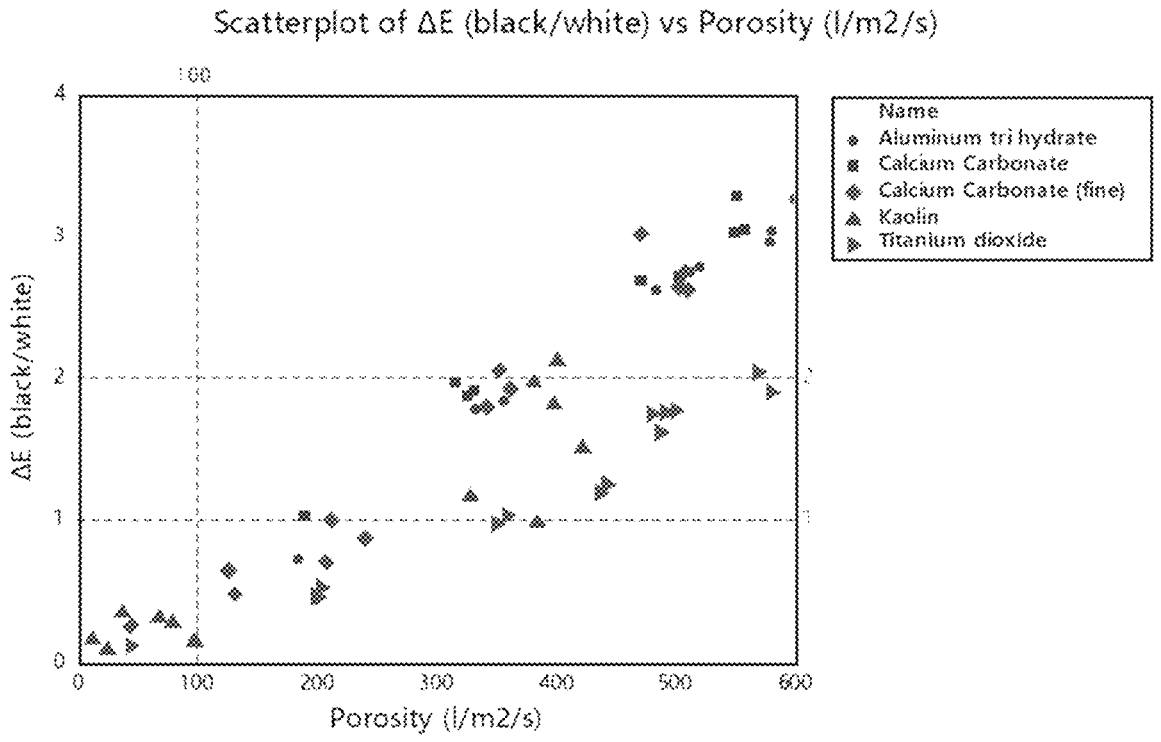
FIG. 1 is a scatterplot of stain covering ($\Delta E$) versus acoustic openness (porosity) of mats with different fillers.

As described above, the renovation mats and systems of the present invention comprise a non-woven web of fibres, a first binder, a filler, and a second binder.

The non-woven web of fibres, bound together with a (first) binder, may be referred to as a "veil", as is known in the art. The terms "non-woven", "veil" and "scrim" are used interchangeably herein and refer to a bound web of fibres.

The terms "mat" and "renovation mat," are used interchangeably herein to refer to a veil, sheet, or the like comprised of a web of fibres (i.e. a bound web of fibres as described above) which has been impregnated with one or more fillers. Impregnation is preferably such that it meets one or more performance standards described herein for renovating i.e., improving the aesthetic performance of an installed ceiling tile.

The fibres making up the non-woven web of fibres may be composed of various materials. Preferably the fibres are glass fibres i.e. the web of fibres is a non-woven web of glass fibres. Additionally, however, it should be appreciated that other fibres like synthetic polymer (for example, polypropylene, polyethylene, polyester, polyethylene terephthalate, polybutylene terephthalate, aramid, nylon, rayon, viscose, polyimide, polyetherimide, polyamide, carbon fibre), natural fibres (for example, cotton, hemp, kenaf, jute, cellulose), organic and inorganic fibres, both natural and manmade, may be utilized. For example, in certain exemplary embodiments, the web of fibres is comprised of basalt fibres.

Preferred glass fibres may include Advantex glass fibres. Particularly preferred are so-called wet use chopped strands (WUCS). These glass fibre filaments are specifically engineered for use in wet-process, non-woven applications. Wet chopped strands disperse quickly and uniformly in process water.

The thickness of the fibres may vary from about 6 microns to about 21 microns (average diameter). The length of the fibres may vary from about 4 mm to about 38 mm. The diameter of the fibres can be measured using an electron microscope. The average diameter is determined over a minimum of 100 measurements. In some embodiments, mixtures of different fibres (i.e. different thicknesses and/or different lengths and/or different types of fibre) may be used.

The terms "filler" and "impregnant" are used interchangeably herein to refer to materials that are added to a web of fibres to modify one or more performance related attributes. Suitable fillers are described in detail herein. In general terms, a suitable filler is an inorganic, particulate solid (powder) which is white in colour.

In the renovation mats of the invention, the filler comprises one or more of the following: aluminium trihydrate, calcium carbonate, magnesium oxide, magnesium hydroxide, titanium dioxide, talc, barium sulphate, kaolin, and mixtures thereof.

In some embodiments the filler comprises aluminium trihydrate (ATH), which may be beneficial for fire retardance. In some embodiments, the filler preferably comprises aluminium trihydrate in an amount of at least 30% by weight of the solids in the filler, more preferably at least 50% by weight. In these embodiments the filler further comprises at least one of calcium carbonate, magnesium oxide, magnesium hydroxide, titanium dioxide, talc, barium sulphate, kaolin, or mixtures thereof.

In some preferred embodiments, the filler comprises at least one of calcium carbonate, magnesium oxide, magnesium hydroxide, titanium dioxide, talc, barium sulphate, and kaolin. In more preferred embodiments, the filler comprises at least one of: magnesium oxide, magnesium hydroxide, titanium dioxide and kaolin. In further preferred embodiments, the filler comprises titanium dioxide or kaolin.

The filler is preferably present in the mat in an amount of 100 g/m$^2$ to 500 g/m$^2$, more preferably from 150 g/m$^2$ to 310 g/m$^2$.

The term "binder," as used herein, refers to a material that holds one or more components of the renovation mat together. Suitable binders are described in detail herein. In the renovation mats of the invention the first binder serves to hold together the non-woven web of fibres (i.e. before impregnation). A second binder is used with the filler to impregnate the non-woven web of fibres and provide the desired physical properties.

In some embodiments, the first binder is selected from thermoplastic and thermoset resins such as polyvinyl alcohol, latexes, acrylics, acrylic acids, epoxy, polyurethanes, melamine, urea formaldehyde, polyester resins, vinyl esters; binders can also be selected from starches, cellulose, saccharides, and combinations thereof. In preferred embodiments, the first binder is polyvinyl alcohol.

In some embodiments, the second binder is selected from thermoplastic and thermoset resins such as polyvinyl alcohol, latexes, acrylics, acrylic acids, epoxy, polyurethanes, melamine, urea formaldehyde, polyester resins, vinyl esters; binders can also be selected from starches, cellulose, saccharides, and combinations thereof. In preferred embodiments, the second binder is polyvinyl alcohol, latex, or a blend thereof.

The binders may be present in the renovation mat in an amount of 5% to 35% by weight (i.e. from 5% to 35% of the total weight of the renovation mat is made up of the two binders).

The term "add-on," as used herein, refers to the amount of filler or impregnant or coating or combinations thereof that is included in a renovation mat.

The renovation mats of the present invention advantageously have the property of being acoustically open. The term "acoustic openness", as used herein, refers generally to the quality of a renovation mat to allow sound to pass through. This is important in ensuring that the acoustic performance of the existing ceiling panels is maintained after renovation using the systems and methods of the invention.

Acoustic absorption is measured by ASTM C423 (NRC—noise reduction coefficient) and EN 13964. Acoustic performance of the mat may be determined by a variety of methods. In the present invention, exemplary methods to measure the acoustic openness or performance of a renovation mat include airflow resistance (mks rayls) and porosity (l/m$^2$/sec). Air porosity may be measured according to ISO9237. Airflow resistance may be measured according to ASTM C522-03 (2016).

The mats of the present invention preferably have an air porosity of >100 l/m$^2$/sec at 100 Pa. The present inventors have found that this provides acceptable acoustic performance of the renovation mat i.e. the mat can be considered 'acoustically open'. Alternatively or additionally, the mats of the present invention may have an airflow resistance of <600 MKS Rayls.

The renovation mats of the present invention also advantageously provide an acceptable aesthetic performance, when used in the renovation systems and methods described herein.

The term "aesthetic performance," as used herein, refers to the capacity of a renovation mat to hide, for example, a stain on an existing ceiling tile. Stain covering (one form of aesthetic performance) can be determined by measuring the colour difference of the renovation mat with a white background versus a coloured background (stained surface). More difficult stains are represented by a black or blue coloured background. A grey or yellow stain (or corresponding background during testing) is more easily covered.

The colour difference (stain covering) can be quantified as DELTA-E ($\Delta E$, $\Delta E_{76}$). This is a single number used in colour science and is calculated as a distance in the three dimensional colour space (L*, a*, b*) to quantify colour differences. As it is described in the article "Colour difference ΔE—A Survey", by Mokrzycki W. S., October 2012, University of Warmia and Mazury, details are given on $\Delta E$, $\Delta E_{76}$ and its thresholds. As used herein, the terms DELTA-E, delta-E, $\Delta E$, and $\Delta E_{76}$ are interchangeable and all refer to $\Delta E_{76}$ i.e. $\Delta E$ as calculated according to the CIE 1976 equation (see below).

In cases where $1<\Delta E_{76}<2$, the difference is only noticed by an experienced observer. When $\Delta E_{76}>2$, the difference is noticeable by inexperienced observers.

In the present invention, it is determined by measuring the colour of the renovation mat over a white and a black background (specifically, over a white and black measuring card, such as a 2 A opacity card from the Leneta Company). The black background represents the 'worst case' i.e. the most difficult stain covering challenge. The colour measurements can be conveniently carried out using a spectrophotometer or colourimeter, as is known in the art. Values for L*, a* and b* for the mat over each background colour are determined directly from the measuring device and/or are readily converted from x, y, z (R, G, B) tri-stimulus values. The difference in colour is expressed as $\Delta E$ (delta-E, $\Delta E_{76}$) and is calculated using the formula:

$$\Delta E=\sqrt{((L_1^*-L_2^*)^2-(a^*_1-a_2^*)^2-(b_1^*-b_2^*)^2)}$$

The smaller the difference, the lower the $\Delta E$ number. In certain exemplary embodiments, the renovation mat of the present invention has a $\Delta E_{76}<3$ (or <3); including a $\Delta E_{76}<2$ (or <2), and including a $\Delta E_{76}<1$ (or <1). Preferably, the renovation mat has a $\Delta E$ of 2 or below.

The mat of the present invention may also be finished with an optional coating layer. This coating layer can be applied using various coating techniques such as roll coating, knife coating, screen printing, impregnation, curtain coating, brush coating or spray-painting techniques. The final coated product should have the target stain covering and acoustic performance.

Ranges as used herein are intended to include every number and subset of numbers within that range, whether specifically disclosed or not. Further, these numerical ranges should be construed as providing support for a claim directed to any number or subset of numbers in that range. For example, a disclosure of from 1 to 10 should be construed as supporting a range of from 2 to 8, from 3 to 7, from 5 to 6, from 1 to 9, from 3.6 to 4.6, from 3.5 to 9.9, and so forth.

All references to singular characteristics or limitations of the present disclosure shall include the corresponding plural characteristic or limitation, and vice versa, unless otherwise specified or clearly implied to the contrary by the context in which the reference is made.

All combinations of method or process steps as used herein can be performed in any order, unless otherwise specified or clearly implied to the contrary by the context in which the referenced combination is made.

In certain exemplary embodiments, the renovation mat comprises an outward side and an inward side, the outward side being opposite to the inward side. In certain exemplary embodiments, the outward side may be a front side which is facing towards a building space or room environment and the inward side may be a rear side which is facing the ceiling tile or tiles being covered and, thus, is concealed from view when the mat is mounted.

DETAILED DESCRIPTION AND DISCUSSION

The general inventive concepts described herein relate to and contemplate a non-woven fibreglass mat for use in an existing ceiling tile framework.

When developing a mat for use in renovating the aesthetics of an existing ceiling tile framework, there are a number of properties that must be balanced against one another. For instance, in certain embodiments, the mat should be opaque enough to cover stains while also being acoustically open enough not to influence the acoustics of the existing ceiling tile. The mat should be both stiff and light enough not to have visual sag when installed, but at the same time, flexible and resilient enough to be installed under a suspended ceiling tile in an existing framework without being damaged. The mat should not influence the fire performance of the existing ceiling tile framework. Thus, the inventive mat combines all the above features in a unitary structure while balancing the above properties.

While the general inventive concepts are susceptible of embodiment in many different forms, there are shown in the drawings, and will be described herein in detail, specific embodiments thereof with the understanding that the present disclosure is to be considered as an exemplification of the principles of the general inventive concepts. Accordingly, the general inventive concepts are not intended to be limited to the specific embodiments illustrated herein.

The materials, systems, and methods described herein are intended to be used to renovate the aesthetics of an existing network of acoustic ceiling tiles. More specifically, the non-woven fibreglass mats disclosed or suggested herein can be used in an existing drop ceiling framework and cover an existing ceiling tile to renovate the aesthetics of the existing ceiling tile (e.g., to cover stains) while relying on the acoustical and other performance (e.g., fire retardance) attributes of the ceiling tile.

Numerous benefits result from employing the materials, systems, and methods according to general inventive concepts. The methods described herein, or otherwise encompassed by the general inventive concepts, provide a simple and convenient approach for renovating suspended ceiling framework and, more particularly, improving the aesthetics of ceiling tiles. Since the old ceiling tiles are maintained in the space above the mat, there is little or no mess created during renovation and the time and effort otherwise required to remove the old ceiling tiles and discard them is eliminated. Accordingly, installation costs are greatly reduced. Further, use of the mat allows one to aesthetically upgrade any existing suspended ceiling independent of the ceiling type and design. Since the existing ceiling tiles remain in place on the ceiling tile framework (grid), hidden by the mat, the original technical properties of the ceiling relating, for example, to fire rating and acoustical characteristics are at least maintained if not improved by the use of the mat. Further, since the ceiling tiles may be replaced without creating any substantial mess and without necessitating their removal, renovation and replacement can be done in a normal work environment with minimal disruption to the work area.

In an exemplary embodiment, a non-woven fibreglass mat for use in an existing ceiling tile framework is provided. The mat ('renovation panel') comprises a non-woven web of fibres; a first binder; a filler; and a second binder. The non-woven web of fibres and the first binder have an area weight of 40 g/m$^2$ to 200 g/m$^2$ prior to inclusion of the filler. In some embodiments, the filler comprises aluminium trihydrate in an amount of at least 30% by weight of the solids in the filler and at least one of aluminium trihydrate, calcium carbonate, titanium dioxide, talc, barium sulphate, and kaolin.

In an exemplary embodiment, a non-woven fibreglass mat comprising a web of fibres, a first binder, a filler, and a second binder, is provided. The mat meets at least one of the following: an air porosity of >100 l/m$^2$/sec at 100 Pa and $\Delta E<1$. Air porosity may be measured according to ISO9237, as described herein.

In an exemplary embodiment, a non-woven fibreglass mat is provided. The mat has a thickness of 0.5 to 2.5 mm, and meets at least one of the following: an air porosity of at least 50 l/m$^2$/sec at 100 Pa, preferably at least 100 l/m$^2$/sec at 100 Pa; and $\Delta E<3$, preferably $\Delta E\leq 2$, more preferably $\Delta E\leq 1$.

In an exemplary embodiment, a non-woven fibreglass mat comprising a web of fibres, a first binder, a filler, and a second binder, is provided, wherein the web of bound fibres has an area weight of 40 g/m$^2$ to 200 g/m$^2$ prior to inclusion of the filler, and wherein the filler is present in the mat in an amount of 100 g/m$^2$ to 350 g/m$^2$, preferably 150 g/m$^2$ to 310 g/m$^2$.

In an exemplary embodiment, a method for improving the aesthetics of an acoustic panel is provided. The method comprises positioning a non-woven fibreglass mat under a ceiling tile in an existing ceiling tile framework. The mat comprises a non-woven web of fibres; a first binder; a filler; and a second binder. The non-woven web of fibres and the first binder have an area weight of 40 g/m$^2$ to 200 g/m$^2$ prior to inclusion of the filler. In some embodiments, the filler comprises aluminium trihydrate in an amount of at least 50% by weight of the solids in the filler and at least one of aluminium trihydrate, calcium carbonate, titanium dioxide, talc, barium sulphate, and kaolin.

In some embodiments, the mat is placed under a single corresponding ceiling tile. More specifically the non-woven fibreglass mat is placed between the ceiling tiles and frame that supports the tile. In some embodiments, the mat is placed under a plurality of the ceiling tiles in the existing ceiling tile framework. In some embodiments, the mat is placed under all of the tiles in the ceiling tile framework.

In an exemplary embodiment, a method of improving the aesthetics of an installed ceiling tile is provided. The method comprises positioning a non-woven fibreglass mat under a ceiling tile in an existing ceiling tile framework, wherein the mat has a thickness of 0.5 to 2.5 mm, and meets at least one of the following: an air porosity of 100 $l/m^2/sec$ and $\Delta E<3$, preferably $\Delta E<2$, more preferably $\Delta E<1$.

A market has emerged for "renovation" ceilings that renew or renovate the aesthetics of an existing ceiling tile framework, without the need to replace it entirely. The renovation ceiling consists of a relatively thin sheet of material (i.e., a mat, veil, scrim, facer, or the like) which is placed under an existing ceiling panel (i.e., the renovation mat is placed in a manner such that it is situated between the occupied area of a structure and the existing ceiling tile). The renovation mat is designed to cover the surface of one or more ceiling panels that were formerly exposed to the occupied space in a room/structure so as to provide an improved/renewed appearance, while relying on the acoustic performance of the existing ceiling tile situated behind the mat.

When developing a mat for use in renovating the aesthetics of an existing ceiling tile framework, there are a number of properties that must be balanced against one another. For example, in general, the renovation mat should be opaque enough to cover stains and acoustically open enough not to influence the acoustics of the existing ceiling tiles. As another example, the renovation mat should be stiff and light enough not to have visual sag.

After installation but at the same time flexible and resilient enough to be installed under a suspended ceiling tile in an existing ceiling tile framework without being damaged. Furthermore, the renovation mat should not influence the fire performance of the existing ceiling tiles. The general inventive concepts are able to combine these features in one unitary structure while balancing these competing properties, thereby achieving a renovation mat that can provide the above mentioned properties.

The renovation mat effectively balances stain covering/opacity and the ability to be acoustically open (i.e., not degrade the acoustic absorption of the overall ceiling tile assembly). The mat also avoids problems that might otherwise arise due to the fact that, by increasing its weight (e.g., by including additional stain covering fillers), the potential for unwanted sagging and deflection of the mat once installed in the ceiling (which is known to increase with increasing weight) may also increase.

In an exemplary embodiment, the general inventive concepts relate to a material for use in renovating an existing ceiling panel (tile) assembly. In contrast to an acoustic ceiling tile which will generally have a thickness falling between 10 and 50 mm, the material is in the form of a renovation mat, as described herein, will generally have a thickness that falls between of 0.5 to 2.5 mm In general, the renovation mat is comprised of a web of fibres (e.g., glass) bound together with a first binder in an area weight of from 40 $g/m^2$ to 200 $g/m^2$. In certain embodiments, the renovation mat is comprised of a web of fibres and a first binder in an area weight of from 70 $g/m^2$ to 130 $g/m^2$.

In certain exemplary embodiments, the web of fibres is comprised of glass fibres. The thickness of the fibres may vary from about 6 microns to about 21 microns. The length of the glass fibres may vary from about 4 mm to about 38 mm. Additionally, it should be appreciated that other fibres like synthetic polymer (for example, polypropylene, polyethylene, polyester, polyethylene terephthalate, polybutylene terephthalate, aramid, nylon, rayon, viscose, polyimide, polyetherimide, polyamide, carbon fibre), natural fibres (for example, cotton, hemp, kenaf, jute, cellulose), organic and inorganic fibres, both natural and manmade, may be utilized. For example, in certain exemplary embodiments, the web of fibres is comprised of basalt fibres. In certain embodiments, the web of fibres is a non-woven web of glass fibres.

In certain exemplary embodiments, the first binder is selected from thermoplastic and thermoset resins such as polyvinyl alcohol, latexes, acrylics, acrylic acids, epoxy, polyurethanes, melamine, urea formaldehyde, polyester resins, vinyl esters; binders can also be selected from starches, cellulose, saccharides, and combinations thereof. In certain exemplary embodiments, the first binder is polyvinyl alcohol. In certain exemplary embodiments, a binder is present in the renovation mat in an amount of 5% to 35% by weight.

In certain exemplary embodiments, a filler composition is applied to a non-woven fibre material to produce a renovation mat. The filler composition may comprise components that improve one or more physical characteristics of the renovation mat, thereby making the mat more suitable for renovating ceiling tiles (e.g., light reflectance, acoustic openness, whiteness, fire resistance). In an exemplary embodiment, a filler composition is applied to a non-woven glass fibre mat, thereby fillers are impregnated into the web of glass fibres along with a binder to generate a renovation mat.

In certain exemplary embodiments, the fibre web is impregnated with a mixture of fillers and a secondary binder (collectively referred to as an impregnation). In certain exemplary embodiments, aluminium trihydrate is a primary component of the filler and makes up 30% to 100% by weight of the filler. In certain exemplary embodiments, a secondary component is present in the filler in an amount of 0% to 70% by weight of the filler. In certain exemplary embodiments, aluminium trihydrate is a primary component of the filler and is present in an amount of at least 50% (i.e., 50 to 100%) by weight of the solids in the filler. In certain exemplary embodiments, a secondary component is present in the filler in an amount of 0% to 50% by weight of the filler. In certain exemplary embodiments, the second filler (i.e. the secondary component of the filler) is selected from aluminium trihydrate; calcium carbonate; metal oxides such as aluminium oxide, titanium dioxide, magnesium oxide; magnesium hydroxide; talc; barium sulphate; calcium sulphate; magnesium sulphate; kaolin; china clay; nanoclay; graphene; zeolites; silica; silicates; glass; and mica. In certain exemplary embodiments, the filler has a particle size from coarse to medium to fine. In certain exemplary embodiments, the particle size of the filler is in the range of 0.5 micron to 100 microns. In certain exemplary embodiments, the filler should deliver both acceptable stain covering performance ($\Delta E<1$) and acceptable acoustic performance (porosity >100 $l/m^2/sec$), which may alternatively be expressed as low airflow resistance (<600 MKS RAYLS).

In certain exemplary embodiments, the second binder is selected from a latex binder, an acrylic binder, a polyvinyl alcohol, a vinyl ester binder, epoxy binder and combinations thereof. In certain embodiments, the second binder is polyvinyl alcohol.

In certain exemplary embodiments, the filler(s) and second binder are included in the renovation panel in an amount of 100 $g/m^2$ to 500 $g/m^2$, including 150 $g/m^2$ to 320 $g/m^2$, including 180 $g/m^2$ to 310 $g/m^2$, and including 150 $g/m^2$ to 310 $g/m^2$.

In certain exemplary embodiments, the impregnation composition can be applied in the form of atomized droplets to the outward surface of the bound web of fibres. In certain embodiments, the impregnation can be applied by liquid, spray, mist, fogs, clouds, or aerosol. In certain exemplary embodiments, the impregnation can be applied by roll coating, knife coating, screen printing, full bath impregnation, curtain coating, brush coating or spray-painting. In certain exemplary embodiments, the renovation mat demonstrates good stain covering performance. In certain exemplary embodiments, the renovation mat has a $\Delta E<3$. In certain exemplary embodiments, the renovation mat has a $\Delta E<2$. In certain exemplary embodiments, the renovation mat has a $\Delta E<1$.

In certain exemplary embodiments, the renovation mat can comprise a finishing coating such as a paint layer applied using spray, mist, fogs, clouds, aerosol, liquid applied by roll coating, knife coating, screen printing, full bath impregnation, curtain coating, brush coating or spray-painting.

In certain exemplary embodiments, the renovation mat demonstrates acceptable acoustic performance. In certain exemplary embodiments, the renovation mat has an air porosity >100 $l/m^2/sec$ (i.e., being acoustically open). In certain exemplary embodiments, the renovation mat has an airflow resistance <600 MKS RAYLS (i.e., being acoustically open).

It is known in the art to apply a coating (e.g., a paint) to a non-woven veil during construction of an acoustic ceiling tile. The coating is often applied after production of the veil after impregnation of the veil with any fillers. The coating is typically applied to improve or modify the aesthetics of the acoustic ceiling tile including colours. In contrast, in certain exemplary embodiments, the general inventive concepts provide a renovation mat that does not include a coating. Further, in general, the renovation mat is not attached to a substrate to form an acoustic panel.

As mentioned previously, the general inventive concepts relate to methods of improving the aesthetics of installed ceiling tiles, without degrading acoustic properties of the tiles. In certain exemplary embodiments, the method comprises positioning a renovation mat under one or more ceiling tiles in an existing ceiling tile framework. The renovation mat comprises a non-woven web of fibres; a first binder; a filler; and a second binder. In certain exemplary embodiments, the fibres are glass. The non-woven web of fibres and the first binder have an area weight of 40 $g/m^2$ to 200 $g/m^2$ prior to inclusion of the filler. In some embodiments, the filler comprises aluminium trihydrate in an amount of at least 50% by weight of the solids in the filler and at least one of aluminium trihydrate, calcium carbonate, titanium dioxide, talc, barium sulphate, medium grade china clay, and fine grade china clay.

In certain exemplary embodiments, the general inventive concepts provide a method of improving the aesthetics of a ceiling comprising positioning a renovation mat under one or more ceiling tiles installed in an existing ceiling tile framework. The renovation mat comprises a web of fibres, a first binder, a filler, and a second binder. In certain exemplary embodiments, the fibres are glass. In certain exemplary embodiments, the renovation mat has a thickness of 0.5 to 2.5 mm. In certain exemplary embodiments, the renovation mat demonstrates acceptable acoustic performance. In certain embodiments, the renovation panel has an air porosity >100 $l/m^2/sec$ at 100 Pa. In certain embodiments, the renovation panel has an airflow resistance <600 MKS RAYLS.

In certain exemplary embodiments, the general inventive concepts provide a method of improving the aesthetics of a ceiling, without degrading acoustic properties of the tiles. The method comprises positioning a renovation mat under one or more ceiling tiles in an existing ceiling tile framework, wherein the renovation mat has a thickness of 0.5 to 2.5 mm, and meets at least one of the following: an air porosity >100 $l/m^2/sec$ at 100 Pa and $\Delta E<2$, including $\Delta E<1$.

In certain exemplary embodiments, the method further includes the step of shaping the renovation mat prior to placing the renovation mat in the grid of the ceiling tile framework. The shaping step includes cutting the renovation mat to a proper size to fit the grid. In certain exemplary embodiments, the shaping also includes the step of cutting an opening in the renovation panel in order to accommodate an obstruction such as a light fixture, speaker, smoke detector, pipe, sprinkler head, or the like. Further, the method includes the optional step of applying adhesive tape or adhesive spray or coating to the renovation mat prior to placing the renovation mat in the grid. In certain exemplary embodiments, the renovation mat is substantially parallel to the ceiling when installed. In certain exemplary embodiments, more than one renovation mat is positioned under the tiles of the ceiling tile framework.

While particular embodiments are described herein, one of ordinary skill in the art will recognize that various other combinations of elements are possible and will fall within the general inventive concepts. Likewise, one of ordinary skill in the art will understand that the various embodiments of renovation mats described herein are suitable for use in the methods described herein.

EXAMPLES

As previously mentioned, when developing a renovation mat, it is important to balance the stain covering/opacity of the renovation mat and the ability of the renovation mat to be acoustically open and not to degrade the acoustic absorption of the existing ceiling tile framework (or the individual ceiling tiles with which it is associated). To this end, a series of renovation mats were constructed and tested at various add-on amounts. These products were made by application of an impregnation (filler composition) on a bound web of non-woven glass fibres.

In this example, a 50 grams per square meter ($g/m^2$) veil was used, composed of glass fibres 85 wt % and polyvinyl alcohol binder 15 wt %. The glass fibres used in this example are so called wet used chopped strands made from Advantex E glass. The glass fibres in this example are a blend of 11 μm/6 mm and 6.5 μm/6 mm fibres at a 70 wt %-30 wt % ratio. A veil is formed by using these dispersed fibres in a wet laid process using an inclined wire former. The veil is fed to a belt dryer and dried and cured to form a pre-bonded sheet. The sheet is subsequently in line impregnated using a size press Foulard applicator using a series of impregnation recipes. Add on is controlled using a foulard pressure and a vacuum system. The impregnated sheet is fed to a dryer and the product is obtained.

The composition of the impregnation consists, in general, of at least one inorganic filler and a binder (often organic). In this example, the composition of the impregnation consists of at least one inorganic filler and an organic binder and is applied as a 55 wt % dispersion in water. After drying, the filler to binder ratio is 95:5. The binder in the impregnation recipe used is a 1:5 blend of a polyvinyl alcohol binder and a latex binder. An example recipe is seen in Table 1.

TABLE 1 example recipe
Example recipe

| Type | Chemistry | Weight as dosed | Weight in impregnation (dry) |
|---|---|---|---|
| Defoamer | Polydimethylsiloxane emulsion | 2.1 | 0.0 |
| Filler 1 - slurry | Aluminium trihydrate | 100.0 | 68.0 |
| Filler 2 - slurry | Varied inorganic slurry types | 100.0 | 68.0 |
| Latex binder | Styrene acrylic - 50% | 11.8 | 5.9 |
| PVA binder | 10% Poly vinyl alcohol solution | 11.8 | 1.2 |
| Water | Water | 34.5 | 0.0 |
| TOTAL | | 260.1 | 143.1 |

In the examples shown in FIG. 4 and in Tables 2 and 3 below, 50 wt % of the inorganic filler is aluminium trihydrate (for fire retardance). The other 50 wt % of the filler material is selected from aluminium trihydrate, calcium carbonate, medium grade china clay (kaolin), fine grade china clay, and titanium dioxide.

The add-on level (amount of filler and binder) is between 100 g/m$^2$ and 500 g/m$^2$. By varying the add-on level, the stain covering performance and the porosity/acoustic openness can be assessed. This can lead to a combined stain covering and acoustic open product.

Figure 3:
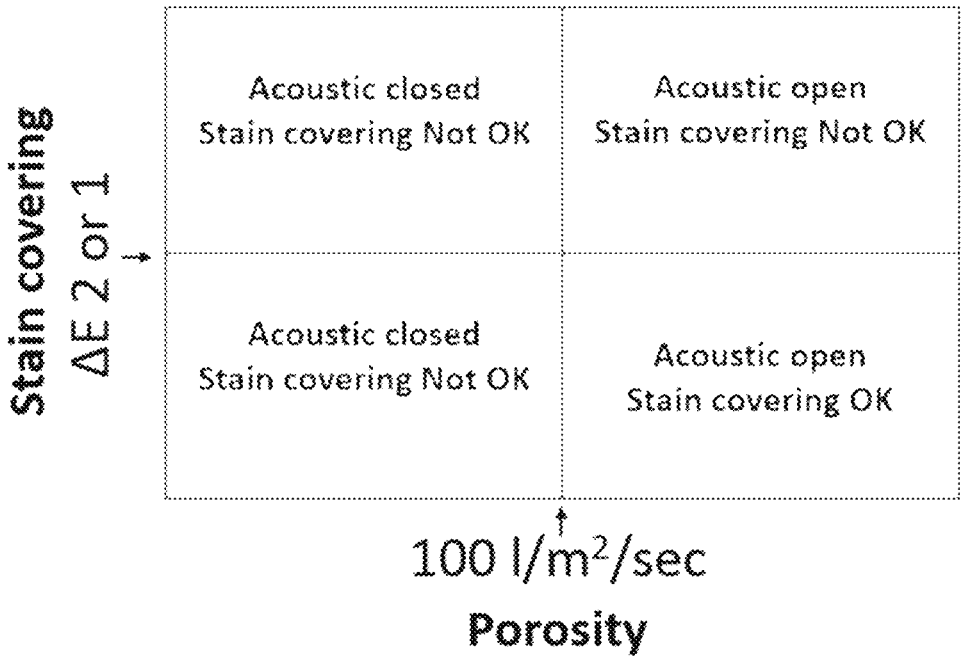
FIG. 3 is a schematic representation of combining stain covering and porosity (acoustics).

As can be seen from FIG. 3, there is an area of the graph that shows good performance in both stain covering and acoustic performance. Other areas are either not stain covering or too closed for porosity, or both.

Figure 4:
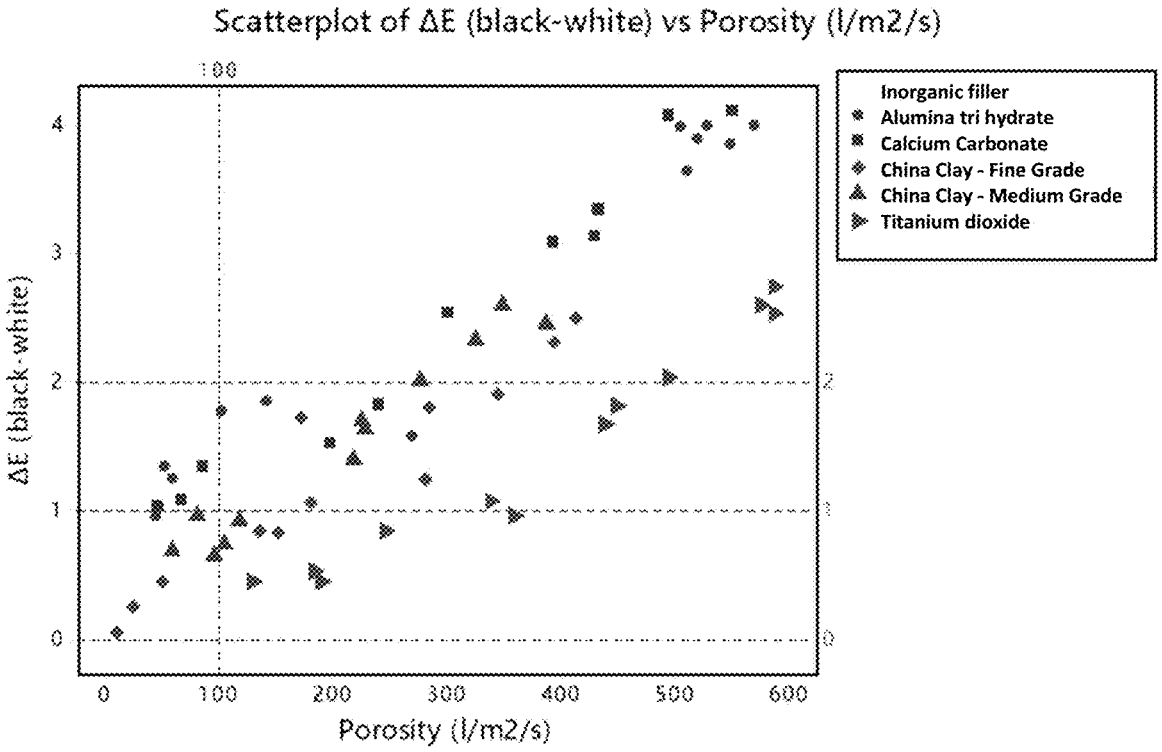
FIG. 4 is a scatterplot showing the measured performance of tested set-ups.

In FIG. 4 the performance of different fillers is shown. The different mineral fillers demonstrate unique performance profiles. Specifically, the samples made with a titanium dioxide filler or a fine china clay demonstrate a desirable balance of the required properties, while the calcium carbonate or the aluminium trihydrate did not perform as well. Further, by reducing the add-on weight, the renovation mats according to the general inventive concepts are also able to minimize sagging.

The stain covering capability of the renovation mat (expressed by the colour difference ΔE) may also be correlated to the amount of add-on. Generally, more add-on (i.e., more filler) gives more hiding power. However, there is a tradeoff: more add-on has a negative influence on the processability/line speed (as well as corresponding increases in raw material consumption) and also means more weight per area. Increasing weight per area, in turn, has an effect on the sagging and deflection of the renovation mat once installed in the ceiling. Thus, in some embodiments, a target filler material has high stain covering properties at a low add-on level.

The data shown in FIG. 4 is used to determine the add-on level needed to reach a specific ΔE level. The same is done for porosities, at specific ΔE levels. This is shown in Tables 2 and 3 respectively.

TABLE 2

Add-on (g/m$^2$) for different fillers to reach stain covering levels (ΔE) of 2.0/1.5/1.0/0.5

| Add-on of impregnation (g/m$^2$) | Titanium dioxide | Aluminium trihydrate | Kaolin (fine grade) | Kaolin (medium grade) | Calcium Carbonate |
|---|---|---|---|---|---|
| ΔE = 2.0 | 155 | 225 | 165 | 250 | 205 |
| ΔE = 1.5 | 165 | 265 | 193 | 285 | 235 |

TABLE 2-continued

Add-on (g/m$^2$) for different fillers to reach stain covering levels (ΔE) of 2.0/1.5/1.0/0.5

| Add-on of impregnation (g/m$^2$) | Titanium dioxide | Aluminium trihydrate | Kaolin (fine grade) | Kaolin (medium grade) | Calcium Carbonate |
|---|---|---|---|---|---|
| ΔE = 1.0 | 190 | 310 | 223 | 360 | 275 |
| ΔE = 0.5 | 255 | 365 | 325 | 440 | 310 |

TABLE 3

Porosity (l/m$^2$/sec) corresponding to add-on reported in Table 2

| Porosity (l/m$^2$/sec) | Titanium dioxide | Aluminium trihydrate | Kaolin (fine grade) | Kaolin (medium grade) | Calcium Carbonate |
|---|---|---|---|---|---|
| ΔE = 2.0 | 490 | 200 | 340 | 300 | 250 |
| ΔE = 1.5 | 410 | 100 | 250 | 220 | 175 |
| ΔE = 1.0 | 325 | 25 | 160 | 125 | 50 |
| ΔE = 0.5 | 185 | 0 | 55 | 25 | 0 |

As can be seen e.g. from Tables 2 and 3, different fillers have different performance. For some fillers a lower add on (e.g. 155 g/m$^2$) is needed to reach a ΔE of 2 and for some a higher add-on (e.g. 250 g/m$^2$) is needed to get to this level. To reach a ΔE of 1, the lower amount of add-on is 190 g/m$^2$ (see table 2, titanium dioxide); The higher amount of add-on is 320 g/m$^2$ (Table 2, calcium carbonate) to reach this level of stain covering ΔE.

The corresponding values of porosity, related to Table 2, are reported in Table 3. The set threshold for acoustic openness is an air porosity of at least 100 l/m$^2$/sec at 100 Pa.

In this example the aluminium trihydrate and calcium carbonate become acoustically too closed at stain covering of ΔE equal to 1 or lower, where the titanium dioxide and kaolins are still acoustically open at these levels. The titanium dioxide is the only filler identified to reach an even better stain covering level of ΔE of 0.5 and still remain acoustically open.

Table 4 also shows the average particle size of the individual filler ingredients. While not wishing to be bound by theory, particle size of the filler materials may also play a role in the balance between stain covering and opacity. In general terms, a smaller particle size should result in better stain coverage at a given add-on level.

TABLE 4

Add-on amounts and particle size to reach ΔE of 1

Figure 2:
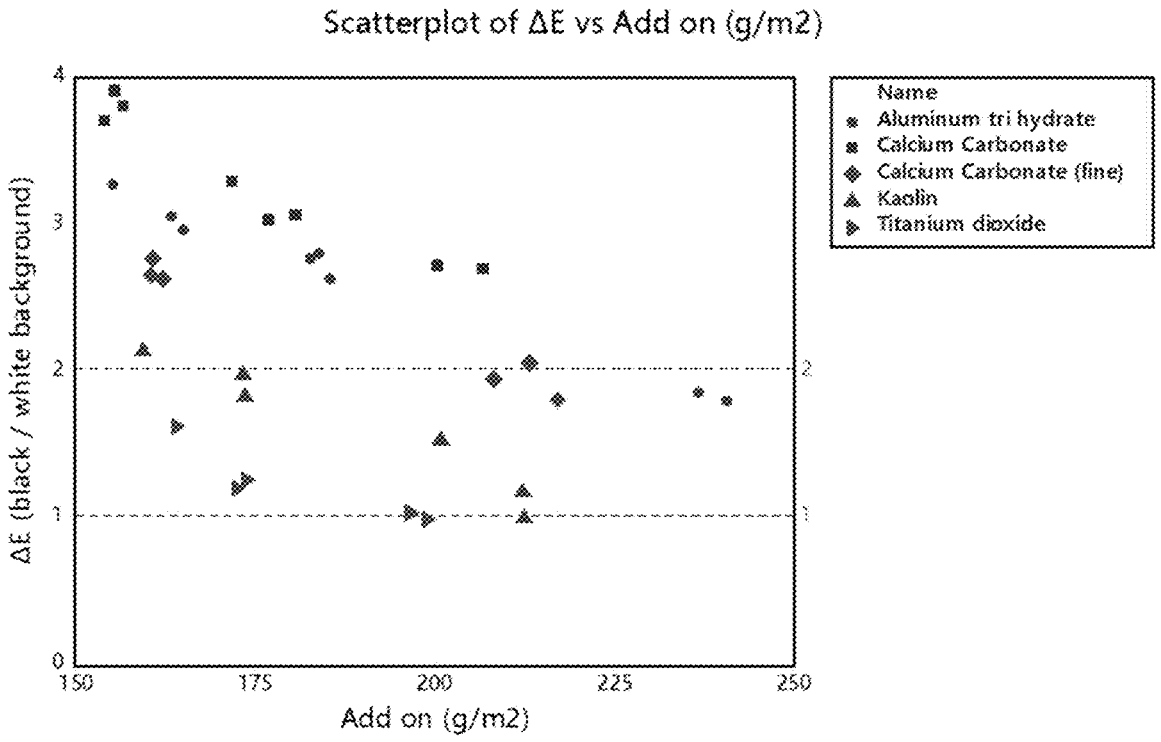
FIG. 2 is a scatterplot of stain covering ($\Delta E$) versus add-on with different fillers.

| Filler | Add-on needed to reach ΔE of 1 (Estimated from FIG. 2) | Average/Median Particle size |
|---|---|---|
| Aluminium trihydrate | 260 g/m$^2$ | 1.5 μm |
| Calcium carbonate | 320 g/m$^2$ | 1.5 μm |
| Fine Kaolin | 200 g/m$^2$ | 0.6 μm |
| Kaolin | 240 g/m$^2$ | 2.0 μm |
| Titanium dioxide | 180 g/m$^2$ | 0.6 μm |

As disclosed and suggested herein, the general inventive concepts relate to and contemplate an improved renovation mat for use in an existing ceiling tile framework. Furthermore, the scope of the general inventive concepts are not intended to be limited to the particular exemplary embodiments shown and described herein. From the disclosure given, those skilled in the art will not only understand the general inventive concepts and their attendant advantages, but will also find apparent various changes and modifications to the methods and systems disclosed. It is sought, therefore, to cover all such changes and modifications as fall within the spirit and scope of the general inventive concepts, as described and suggested herein, and any equivalents thereof.

The invention claimed is:

1. A renovation mat comprising:

a non-woven web of fibers;

a first binder, which holds together the non-woven web of fibers before impregnation;

a filler; and a second binder, used with the filler to impregnate the non-woven web of fibers;

wherein the solids in the filler consist of aluminum trihydrate and, titanium dioxide, and is present in an amount of 100 $g/m^2$ to 500 $g/m^2$;

wherein the filler comprises aluminum trihydrate in an amount of at least about 50% by weight of the solids in the filler;

wherein the web of fibers and the first binder have an area weight of 70 $g/m^2$ to 200 $g/m^2$ prior to inclusion of the filler; and wherein the renovation mat has: an air porosity of at least $100/lm^2/sec$ at 100 Pa according to ISO9237; and a $\Delta E \leq 2$.

2. The renovation mat of claim 1, wherein the web of fibers comprises fibers made from at least one of polypropylene, polyethylene, polyester, polyethylene terephthalate, polybutylene terephthalate, aramid, nylon, rayon, viscose, polyimide, polyetherimide, polyamide, carbon fiber, cotton, hemp, kenaf, jute, cellulose, glass, and basalt.

3. The renovation mat of claim 2, wherein the fibers are glass fibers.

4. The renovation mat of claim 1, wherein the mat has a $\Delta E \leq 1$.

5. The renovation mat of claim 1, wherein the filler is present in an amount of 150 $g/m^2$ to 310 $g/m^2$.

6. The renovation mat of claim 1, wherein at least one of the first binder and the second binder is selected from a latex binder, an acrylic binder, a polyvinyl alcohol binder, a vinyl ester binder, an epoxy binder and combinations thereof.

7. The renovation mat of claim 1, wherein at least one of the first binder and the second binder comprises polyvinyl alcohol.

8. The renovation mat of claim 1, wherein the mat has a thickness of 0.5 mm to 2.5 mm.

9. The renovation mat of claim 1, further comprising a finishing coating.

10. A renovation mat comprising:

a non-woven web of fibers;

a first binder, which holds together the non-woven web of fibers before impregnation;

a filler; and a second binder, used with the filler to impregnate the non-woven web of fibers, wherein the second binder is a mixture of a latex binder and at least one additional binder selected from polyvinyl alcohol, acrylics, acrylic acids, epoxy, polyurethanes, melamine, urea formaldehyde, polyester resins, vinyl esters, starches, cellulose, saccharides, and combinations thereof;

wherein the filler comprises a mixture of aluminum trihydrate and kaolin and is present in an amount of 100 $g/m^2$ to 500 $g/m^2$; wherein the filler comprises aluminum trihydrate in an amount of at least 30% by weight of the solids in the filler;

wherein the web of fibers and the first binder have an area weight of 70 $g/m^2$ to 200 $g/m^2$ prior to inclusion of the filler;

and wherein the renovation mat has:

an air porosity of at least $100/lm^2/sec$ at 100 Pa according to ISO9237; and a $\Delta E \leq 1$.

* * * * *